US008261651B2

(12) United States Patent
Casas Salva

(10) Patent No.: US 8,261,651 B2
(45) Date of Patent: Sep. 11, 2012

(54) AIR OR FIRE RIFLE WITH NOISE DAMPENER

(75) Inventor: Francisco Casas Salva, Sant Boi de Llobregat (ES)

(73) Assignee: GAMO Outdoor, S.L., Barcelona (ES)

( * ) Notice: Subject to any disclaimer, the term of this patent is extended or adjusted under 35 U.S.C. 154(b) by 110 days.

(21) Appl. No.: 12/522,659

(22) PCT Filed: Oct. 31, 2007

(86) PCT No.: PCT/IB2007/054413

§ 371 (c)(1),
(2), (4) Date: Nov. 9, 2009

(87) PCT Pub. No.: WO2008/084345

PCT Pub. Date: Jul. 17, 2008

(65) Prior Publication Data

US 2010/0058922 A1 Mar. 11, 2010

(30) Foreign Application Priority Data

Jan. 12, 2007 (ES) ..... 200700101 U

(51) Int. Cl.
*F41A 21/00* (2006.01)

(52) U.S. Cl. ..... 89/14.4; 181/223

(58) Field of Classification Search ..... 89/14.05, 89/14.2, 14.3, 14.4, 16; 42/76.01, 76.02; 181/223

See application file for complete search history.

(56) References Cited

U.S. PATENT DOCUMENTS

| | | | | |
|---|---|---|---|---|
| 916,885 | A * | 3/1909 | Maxim | 181/223 |
| 1,017,003 | A * | 2/1912 | Kenney | 181/223 |
| 1,111,202 | A * | 9/1914 | Westfall | 89/14.4 |
| 2,448,382 | A * | 8/1948 | Mason | 89/14.4 |
| 3,299,558 | A | 1/1967 | A.R. Karl | |
| 4,769,938 | A | 9/1988 | Chesnut et al. | |
| 5,315,914 | A * | 5/1994 | Schumacher | 89/14.05 |
| 6,575,074 | B1 | 6/2003 | Gaddini | |
| 7,073,426 | B1 * | 7/2006 | White | 89/14.4 |
| 2008/0251060 | A1 * | 10/2008 | Thurber | 124/83 |

* cited by examiner

*Primary Examiner* — Gabriel Klein
(74) *Attorney, Agent, or Firm* — Hartman Global IP Law; Gary M. Hartman; Domenica N. S. Hartman

(57) ABSTRACT

A rifle has a barrel defining a bore therein. A noise damper is provided adjacent a distal end of the barrel and defines a distal extension of the bore of the barrel. The noise damper includes a housing that is over-molded or over-injected on the barrel, such that the barrel, the noise damper and its housing define an integral assembly.

14 Claims, 4 Drawing Sheets

AIR OR FIRE RIFLE WITH NOISE DAMPENER

CROSS-REFERENCE TO RELATED APPLICATIONS

This application is a National Stage of International Application No. PCT/IB2007/054413, filed Oct. 31, 2007, which claims the benefit of Spanish Patent Application No. U 200700101, filed Jan. 12, 2007, the disclosures of both applications being incorporated herein by reference.

BACKGROUND OF THE INVENTION

A rifle comprising a barrel, a bore within the barrel, and a noise damper, wherein the noise damper is over-molded or over-injected on the barrel so that the barrel and noise damper form a single part.

Various silencers and mechanisms to couple the silencer to the barrel of a carbine or pistol are known in the state of the art.

For example, European Patent No 1247057, of 2000, in the name of the company HECKLER & KOCH GMBH is known, which discloses a coupling device to secure a silencer on the barrel of a portable firearm that comprises a fastening for securing the silencer on the barrel of the portable firearm, where the silencer essentially has the form of a tube, with a coupling bracket fitted to the rear end of the silencer, and a barrel mouth that adjusts to the coupling bracket, on which the coupling bracket can be secured, and the barrel mouth presents a non-round configuration, where a supplementary part is installed on the coupling bracket on the side opposite the first and which can rotate with a contra-form complementary to the non-round configuration, so that the supplementary part can be secured to the barrel mouth only in one angular position. The silencer, together with the coupling bracket, is positioned so that it can rotate with respect to the supplementary part, and a blocking device is planed for inclusion, which will immobilize the silencer, together with the coupling bracket on the supplementary part, at a chosen angular position, without it being able to rotate.

The same company also owns European Patent No 1117970 of 2000, which discloses a coupling device for securing a silencer onto the barrel of a portable firearm including a fastening for securing the silencer onto the barrel of the portable firearm with a retention projection, which is positioned on the silencer, and which presents an orifice that centers a contra-projection, which is positioned on the barrel and which presents centered adjustment surfaces that adjust in the orifice, and a pin that can be dismounted for securing the retention projection on the contra-projection, so that the orifice and the adjustment surfaces are positioned centrally in a consecutive fashion in a seating zone, and with which at least one expansion space is provided between the two axial ends of the seating zone.

Lastly, European Patent 0772758 dated 1995 is also known, in the name of Mr Bernard Louvat, which discloses a silencer for a clay-pigeon or sports shotgun. It comprises a tubular body that adapts over the barrel(s) of the firearm and has a ring-shaped decompression chamber behind the tubular body, together with a series of internal transversal baffles held in place by separation parts, and includes orifices that allow the lead shot to pass through and wad evacuation. The silencer is adaptable to all calibers of clay-pigeon and sports shotguns and rifles, single or double-barrel, side-by-side or over/under, together with gauge 12 or 14 garden rifles.

BRIEF DESCRIPTION OF THE INVENTION

This invention is a considerable advance in the air and fire rifles sector because it increases the performance of the firearm and reduces noise.

Economic advantages of the invention arise from a noise damper that is over-molded or over-injected on the barrel of an air or fire rifle so that the barrel and noise damper are a single integral assembly.

In view of the noise damper being manufactured by over-molding or over-injection, the invention also offers significant economic advantages in terms of the production of barrels with noise dampers, since barrels and their noise dampers are usually two independent parts.

As discussed above, the prior art typically requires mechanisms to couple the noise damper to the barrel. The coupling must provide stability (no movement) as well as firing reliability. In other words, it has to fit and, at the same time, remain calibrated with the front and rear sights centered. This is a problem, since centering is required each time the noise damper is coupled to the barrel. In contrast, centering of the sights is not necessary in the exemplary rifle disclosed herein in that the front and rear sights are always centered because the front sight is fixed to the noise damper, which is over-molded or over-injected onto the barrel.

The noise damper also has an improved noise damper insulating mechanism. Traditionally, a series of loose parts are employed in noise dampers, which are then generally wrapped in cotton or similar materials. The exemplary rifle disclosed herein includes a noise damper comprising at least two parts that define an acoustic labyrinth, which is an evident saving from the economic point of view, since the acoustic labyrinth is very easy to install and manufacture. This feature also offers a significant technical improvement, because when the parts are coupled inside the barrel, they correctly center the exit pathway for the bullet or pellet.

An exemplary embodiment described herein provides an air or fire rifle comprising a barrel, a bore within the barrel, and a noise damper, wherein the noise damper is over-molded or over-injected on the barrel so that the barrel and noise dampener form a single, integral part.

BRIEF DESCRIPTION OF THE DRAWINGS

In order to facilitate the description, the present description is accompanied by four sheets of drawings that show an exemplary embodiment, which is cited as a non-limiting example of the scope of the present invention.

DETAILED DESCRIPTION OF THE INVENTION

Figure 1:
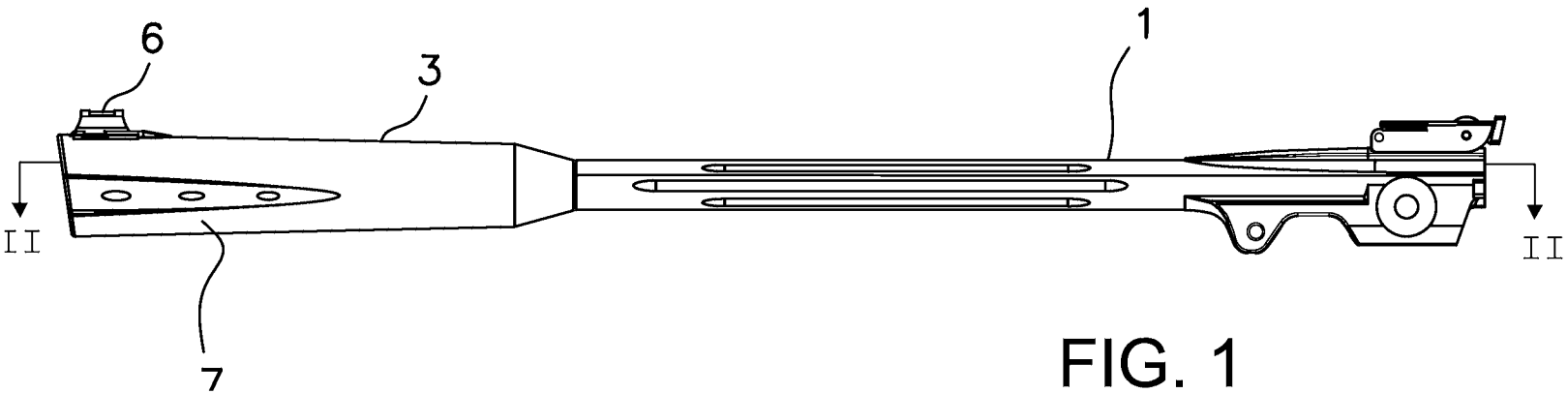
FIG. 1 is a side view of an air or fire rifle according to the exemplary embodiment of this invention.

FIG. 1 illustrates an air or fire rifle comprising a barrel 1 with a bore therein, a sight 6, and a noise damper 3 that has been over-molded or over-injected on the barrel 1.

Figure 2:
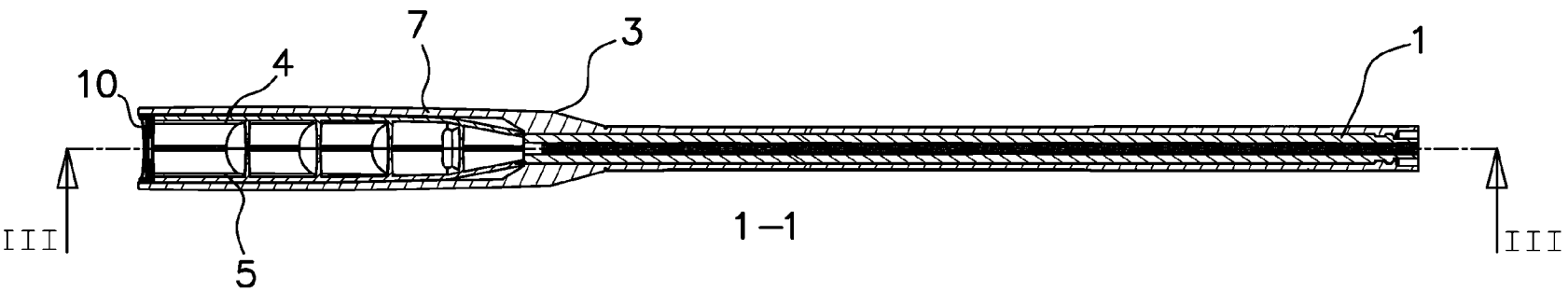
FIG. 2 is a cross-sectional view taken through line II-II of FIG. 1.

FIG. 2 illustrates the barrel 1, the noise damper 3, two parts 4 and 5 of the noise damper 3, and a cover 10.

Figure 3:
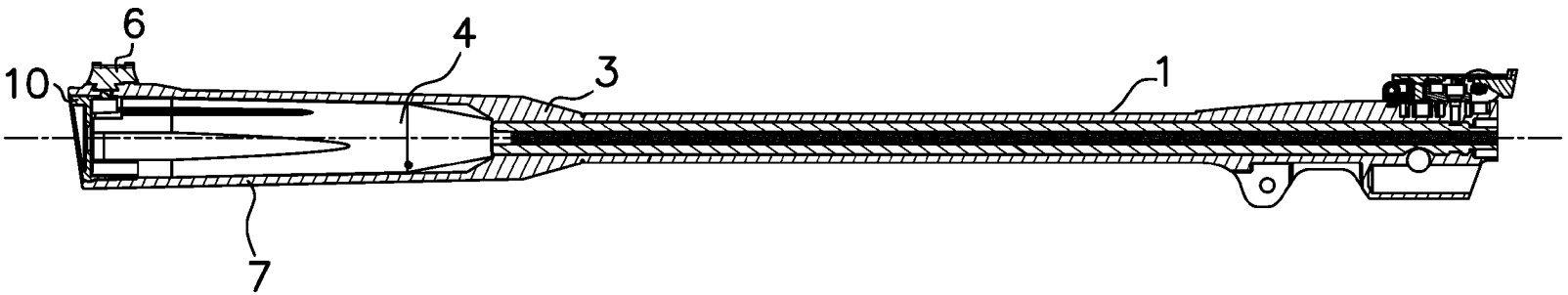
FIG. 3 is a cross-sectional view taken through line III-III of FIG. 2.

FIG. 3 shows the barrel 1, the noise damper 3, the cover 10, the sight 6 and an over-molded or over-injected housing 7 that encloses the parts 4 and 5.

Figure 4:
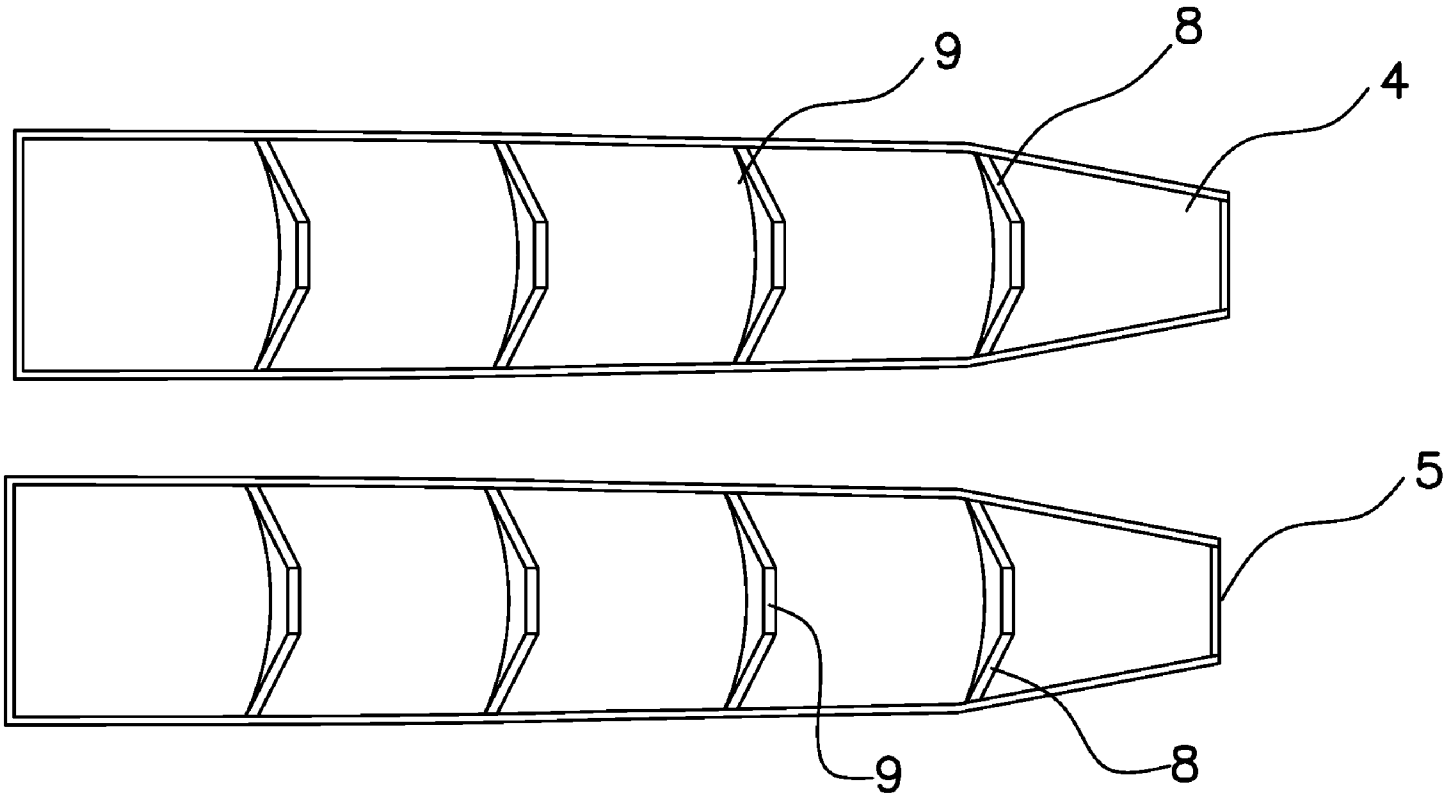
FIG. 4 illustrates two parts of the noise damper of the rifle of FIGS. 1 through 3.

Finally, FIG. 4 shows the parts 4 and 5, each comprising partitions 8 and neckings 9. In an exemplary embodiment, as shown in FIG. 1, the noise damper 3 is over-molded or over-injected on the barrel 1.

In this way, the noise damper 3 and the barrel 1 form a single, integral part.

As can be seen in the section of FIG. 2, the two parts 4 and 5 of the noise damper 3 within the housing 7 define an insulating mechanism of the noise damper 3 by defining an acoustic labyrinth that ends with the cover 10 and provides damping of the firing noise.

Upon assembling the parts 4 and 5, the partitions 8 and the neckings 9 on the partitions 8 define a space or passage between the two parts 4 and 5 as an extension of the bore within the barrel 1.

In an exemplary embodiment, the sight 6 can be fixed onto the noise damper 3, as illustrated in FIG. 1.

This disclosure describes a new air or fire rifle with a noise damper. The examples described here do not limit the present invention, which may have various applications and/or adaptations, all of which are within the scope of the following claims.

The invention claimed is:

1. A rifle, comprising: a barrel defining a bore therein, the bore being configured and dimensioned for a projectile to be fired therethrough; a sound suppressor at a muzzle end of the barrel, the sound suppressor comprising sound suppressing elements, each of the sound suppressing elements defining an acoustic labyrinth therein, the sound suppressing elements being assembled to define a space therebetween, the space acting as an extension of the bore of the barrel; and a structure that is over-molded or over-injected upon the barrel and houses the sound suppressor, said structure: surrounding and in direct contact with the sound suppressor and a majority of the external surface of the barrel, defining an inner housing that houses the sound suppressor, and coupling the sound suppressor to the barrel such that the barrel, the sound suppressor, and the structure define an integral assembly.

2. The rifle of claim 1, wherein each of the sound suppressing elements comprises partitions which at least partly define the acoustic labyrinth thereof.

3. The rifle of claim 2, wherein each of the partitions defines a necking.

4. The rifle of claim 1, further comprising a cover for closing an open end of the housing to retain the sound suppressor therein.

5. The rifle of claim 1, further comprising a sight attached to the housing.

6. A rifle, comprising: a barrel defining a bore therein, the bore being configured and dimensioned for a projectile to be fired therethrough; a sound suppressor disposed at a muzzle end of the barrel; and a structure that is over-molded or over-injected upon the barrel, said structure: surrounding and in direct contact with the sound suppressor and a majority of the external surface of the barrel, defining an inner housing that houses the sound suppressor, and coupling the sound suppressor to the barrel such that the barrel, the sound suppressor, and the structure define an integral assembly.

7. The rifle of claim 6, wherein the sound suppressor comprises a sound suppressing element within the housing adjacent the muzzle end of the barrel, and further wherein the sound suppressing element defines an acoustic labyrinth therein, and further defines a space therein, the space acting as an extension of the bore of the barrel.

8. The rifle of claim 7, wherein the housing houses the majority of the barrel.

9. The rifle of claim 6, wherein the sound suppressor is entirely encased within the housing adjacent the muzzle end of the barrel.

10. The rifle of claim 8, wherein the sound suppressing element comprises partitions which at least partly define the acoustic labyrinth.

11. The rifle of claim 10, wherein each of the partitions defines a necking.

12. The rifle of claim 6, further comprising a cover for closing an open end of the housing to retain the sound suppressor therein.

13. The rifle of claim 6, further comprising a sight attached to the structure.

14. A rifle, comprising: a barrel defining a bore therein, the bore being configured and dimensioned for a projectile to be fired therethrough; a sound suppressor disposed at a muzzle end of the barrel; and a structure that is over-molded or over-injected upon the barrel, said structure: surrounding and in direct contact with a majority of the external surface of the barrel, defining an inner housing that houses the sound suppressor, and coupling the sound suppressor to the barrel.

* * * * *